US010821040B2

(12) United States Patent
Goodrich

(10) Patent No.: US 10,821,040 B2
(45) Date of Patent: Nov. 3, 2020

(54) CONVERTIBLE CHAIR BED DEVICE

(71) Applicant: Leonard Goodrich, Las Vegas, NV (US)

(72) Inventor: Leonard Goodrich, Las Vegas, NV (US)

( * ) Notice: Subject to any disclaimer, the term of this patent is extended or adjusted under 35 U.S.C. 154(b) by 258 days.

(21) Appl. No.: 16/118,615

(22) Filed: Aug. 31, 2018

(65) Prior Publication Data

US 2019/0070049 A1 Mar. 7, 2019

Related U.S. Application Data

(60) Provisional application No. 62/555,581, filed on Sep. 7, 2017.

(51) Int. Cl.

| | |
|---|---|
| ***A61G 5/10*** | (2006.01) |
| ***A47C 3/16*** | (2006.01) |
| ***A47C 20/04*** | (2006.01) |
| ***A61G 5/00*** | (2006.01) |
| *A47C 13/00* | (2006.01) |
| *A47C 17/04* | (2006.01) |

(52) U.S. Cl.

CPC ..... *A61G 5/1067* (2013.01); *A47C 3/16* (2013.01); *A47C 20/043* (2013.01); *A61G 5/006* (2013.01); *A47C 13/00* (2013.01); *A47C 17/04* (2013.01)

(58) Field of Classification Search

CPC ..... A61G 5/1067; A61G 5/006; A47C 3/16; A47C 20/043; A47C 13/00; A47C 13/005; A47C 17/04; A47C 17/12; A47C 17/13; A47C 17/16; A47C 17/162; A47C 17/161; A47C 17/165; A47C 17/17; A47C 17/175; A47C 17/24; A47C 4/02; A47C 4/028; A47C 4/03

USPC ..... 297/118, 440.1, 440.14, 440.16

See application file for complete search history.

(56) References Cited

U.S. PATENT DOCUMENTS

| | | | | | |
|---|---|---|---|---|---|
| 2,678,085 | A * | 5/1954 | De Minno | A47C 20/043 | 297/383 |
| 3,884,522 | A * | 5/1975 | Arima | A47C 17/175 | 297/63 |
| 3,994,526 | A * | 11/1976 | Swain | A47C 13/00 | 297/118 |
| 4,099,768 | A * | 7/1978 | Amos | A47C 1/026 | 297/63 |
| 4,862,529 | A | 9/1989 | Peck | | |
| 5,272,777 | A * | 12/1993 | Favagrossa | A47C 1/143 | 297/22 |
| 5,519,902 | A * | 5/1996 | Meade | A47C 17/161 | 297/354.13 |

(Continued)

*Primary Examiner* — Robert G Santos
*Assistant Examiner* — Rahib T Zaman
(74) *Attorney, Agent, or Firm* — Boudwin Intellectual Property; Daniel Boudwin

(57) ABSTRACT

A convertible chair bed device. The convertible chair bed device includes a frame assembly, having a left bar support and a right bar support, configured to support a plurality of cross bars. The frame assembly is sized to accept a padded base between the left bar support and the right bar support, and the padded base includes a first section pivotally attached to a second section. During use, an individual seated on the padded base, such as a handicapped individual, is able to grip and move any of the plurality of cross bars to independently transition between a seated position and a supine position.

12 Claims, 4 Drawing Sheets

(56) References Cited

U.S. PATENT DOCUMENTS

| | | | | |
|---|---|---|---|---|
| 5,715,548 | A | 2/1998 | Weismiller et al. | |
| 7,926,131 | B2 | 4/2011 | Menkedick et al. | |
| 2002/0130535 | A1* | 9/2002 | Dick | A47C 17/175 297/118 |
| 2014/0157515 | A1 | 6/2014 | Manson | |
| 2014/0239680 | A1* | 8/2014 | Short | A61G 12/008 297/183.6 |
| 2016/0058639 | A1 | 3/2016 | Lacasse et al. | |
| 2018/0000252 | A1* | 1/2018 | Weldon | B62B 1/20 |

* cited by examiner

CONVERTIBLE CHAIR BED DEVICE

CROSS REFERENCE TO RELATED APPLICATIONS

This application claims priority under 35 U.S.C. § 119(e) to U.S. Provisional Application No. 62/555,581 filed on Sep. 7, 2017. The above identified patent application is incorporated by reference herein in its entirety to provide continuity of disclosure.

BACKGROUND OF THE INVENTION

The present invention relates to a convertible chair bed device for enabling an individual, such as a handicapped individual, to independently transition between a seated position and a supine position.

Handicapped individuals often have limited mobility, which makes it difficult for these individuals to get in and out of a chair or a bed unassisted. Many handicapped individuals desire to have a certain degree of independence, and a particular way for these individuals to achieve this independence is by enabling them to independently transition between a seated position and a supine position.

Therefore, there is a need in the art for a convertible chair bed device for enabling a handicapped individual to independently transition between a seated position and a supine position. The present invention addresses this unmet need.

Devices have been disclosed in the art that relate to convertible chair bed devices. These include devices that have been patented and published in patent application publications. These devices are often overly complex, making them difficult to manufacture or maintain. In view of the devices disclosed in the art, it is submitted that there is a need in the art for an improvement to existing convertible chair bed devices. In view of the present disclosure, it is submitted that the present invention substantially diverges in structural and functional elements from devices in the art, and substantially fulfills an unmet need in the art.

SUMMARY OF THE INVENTION

In view of the disadvantages inherent in the known types of convertible chair bed devices in the art, the present invention provides a new and improved convertible chair bed device, wherein the same can be utilized for enabling a handicapped individual to independently transition between a seated position and a supine position.

It is therefore an object of the present invention to provide a convertible chair bed device for enabling a handicapped individual to independently transition between a seated position and a supine position.

Another object of the present invention is to provide a convertible chair bed device that may be readily manufactured from materials that permit relative economy and are commensurate with durability.

In one aspect, the present invention provides a convertible chair bed device, comprising a frame assembly, having a left bar support connected to a right bar support by a cross member, such that the left bar support and the right bar support each have a plurality of notches configured to removably accept a plurality of cross bars therethrough, and a padded base, having a first section pivotally connected to a second section, such that the padded base is removably insertable between the left bar support and the right bar support.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
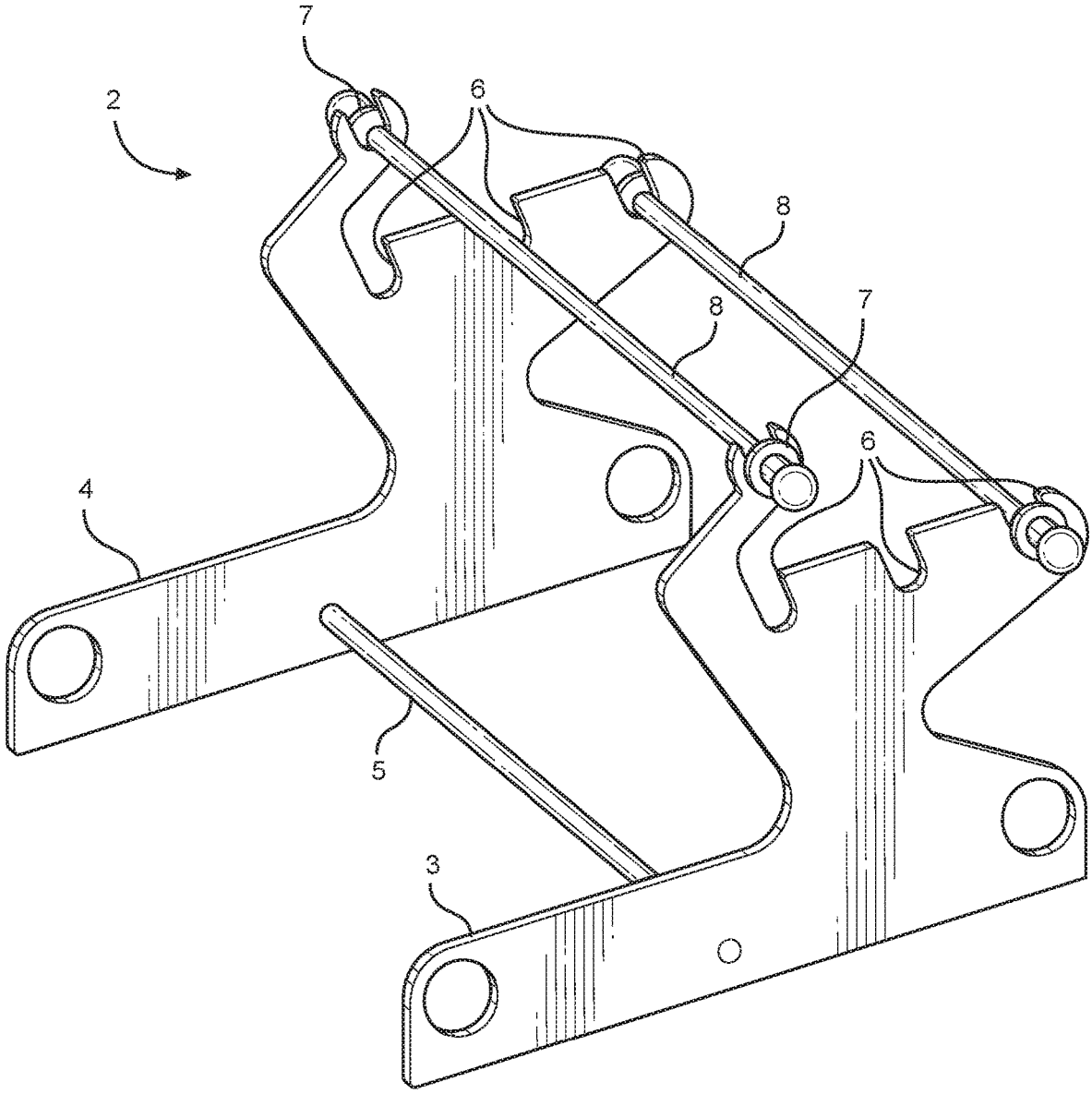
FIG. 1 depicts a front left perspective view of a frame assembly and a plurality of cross bars of an exemplary convertible chair bed device.

Reference is made herein to the attached drawings. Like reference numerals are used throughout the drawings to depict like or similar elements of the portable air filtration device and method. The figures are intended for representative purposes only and should not be considered limiting in any respect.

Referring now to FIGS. 1-5, there are depicted several views of an exemplary convertible chair bed device, and components thereof. Generally, a convertible chair bed device 1 includes a frame assembly 2, having a left bar support 3 connected to a right bar support 4 by a cross member 5, such that the left bar support 3 and the right bar support 4 each have a plurality of notches (6, 7) configured to removably accept a plurality of cross bars 8 therethrough, and a padded base 9, having a first section 10 pivotally connected to a second section 11, such that the padded base 9 is removably insertable between the left bar support 3 and the right bar support 4. Each notch of the plurality of notches (6, 7) of the left bar support 3 is horizontally aligned with a corresponding notch of the plurality of notches (6, 7) of the right bar support 4, forming a pair of notches configured to removably accept a cross bar of the plurality of cross bars 8 therethrough. In this manner, the cross bar extends through the pair of notches perpendicular relative to the left bar support 3, and perpendicular relative to the right bar support 4.

In the shown embodiment, the left bar support 3 includes a forward upper notch 7 within the plurality of notches (6, 7) thereof, and the right bar support 4 includes a forward upper notch 7 within the plurality of notches (6, 7) thereof. In this manner, the forward upper notches 7 are configured to removably accept at least one cross bar of the plurality of cross bars 8 therethrough, such that if the forward upper notches 7 removably accept the at least one cross bar therethrough, an angle between the first section 10 and the second section 11 is maintainable to configure the padded base 9 to support an individual in an upright seated position.

In the shown embodiment, the left bar support 3 includes a plurality of rearward notches 6 within the plurality of notches (6, 7) thereof, and the right bar support 4 includes a plurality of rearward notches 6 within the plurality of notches (6, 7) thereof. In this manner, the pluralities of rearward notches 6 are configured to removably accept the at least one cross bar therethrough, such that if the pluralities of rearward notches 6 removably accept the at least one cross bar therethrough, the angle between the first section 10 and the second section 11 is maintainable to configure the padded base 9 to support the individual in a reclined seated position.

In the shown embodiment, each rearward notch of the pluralities of rearward notches 6 have an upper portion that is angled toward a front of the convertible chair bed device 1 relative to a lower portion of each rearward notch of the pluralities of rearward notches 6, such that the pluralities of rearward notches 6 are configured to facilitate insertion and removal of the at least one cross bar from a forward direction. In this manner, a pushing and a pulling movement of a pair of arms of the individual using the convertible chair bed device 1 is accompanied by the angle of each rearward notch of the plurality of rearward notches 6.

In the shown embodiment, the forward upper notch 7 of the left bar support 3 is disposed on an upper end of a left forward upper arm of the left bar support 3, and the forward upper notch 7 of the right bar support 4 is disposed on an upper end of a right forward upper arm of the right bar support 4. The forward upper arm of the left bar support 3 is angled rearwardly to position the forward upper notch 7 of the left bar support 3 above a rearward notch of the plurality of rearward notches 6 of the left bar support 3, and the forward upper arm of the right bar support 4 is angled rearwardly to position the forward upper notch 7 of the right bar support 4 above a rearward notch of the plurality of rearward notches 6 of the right bar support 4. In the shown embodiment, the forward upper arms are angled rearwardly to position the forward upper notches 7 above forward-most rearward notches of the pluralities of rearward notches 6.

In the shown embodiment, each of the forward upper notches 7 have an upper portion that is angled toward a front of the convertible chair bed device 1 relative to a lower portion of each of the forward upper notches 7, such that the forward upper notches 7 are configured to facilitate insertion and removal of the at least one cross bar from a forward direction. In this manner, the pushing and the pulling movement of the arms of the individual using the convertible chair bed device 1 is accompanied by the angle of the forward upper notches 7.

In the shown embodiment, removal of the at least one cross bar from the pluralities of notches (6, 7) allows the second section 11 to lower to a floor of an environment containing the convertible chair bed device 1, such that the angle between the first section 10 and the second section 11 is maintainable to configure the padded base 9 to support the individual in a supine position.

Figure 2:
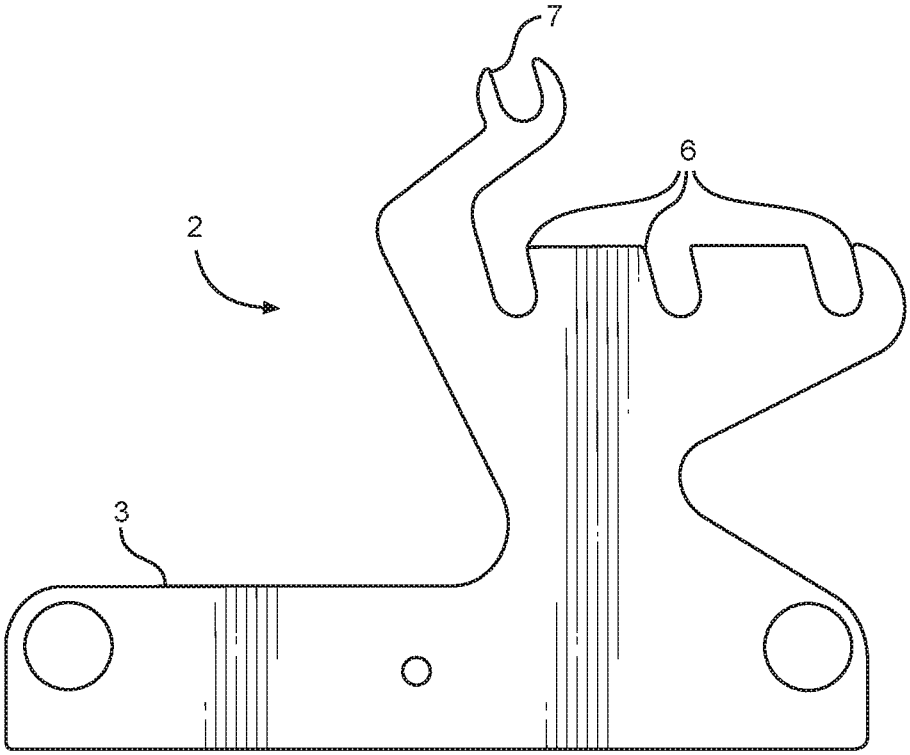
FIG. 2 depicts a left side view of the frame assembly of the exemplary convertible chair bed device.
Figure 3:
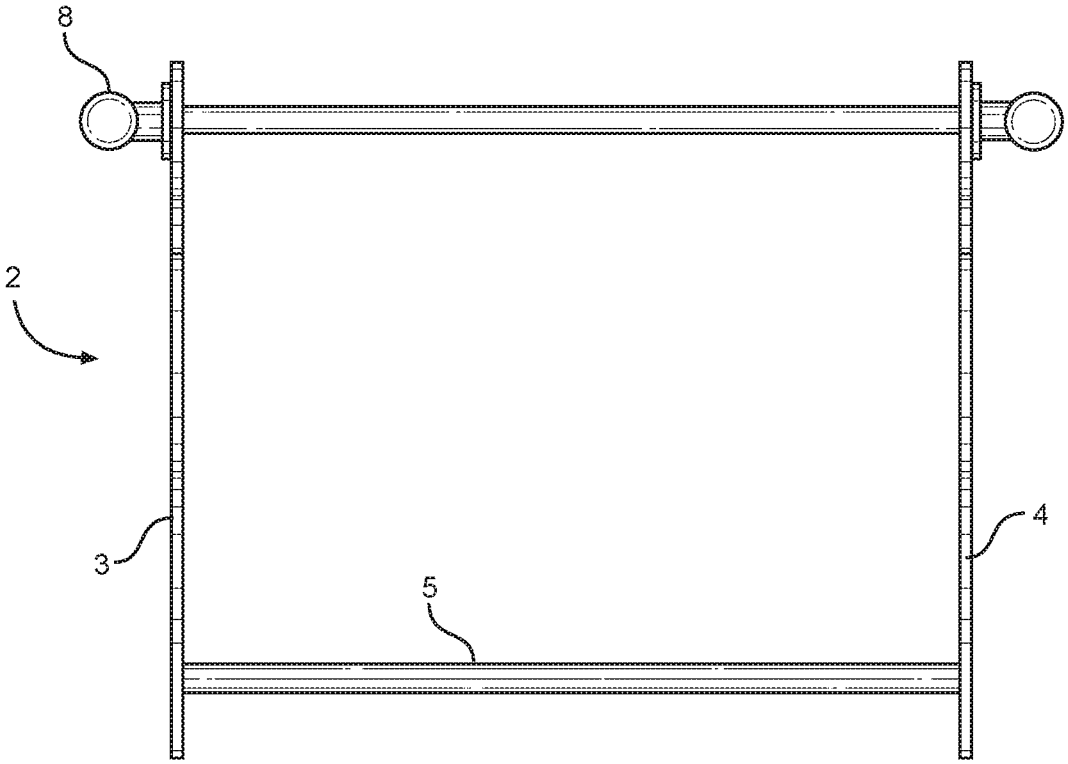
FIG. 3 depicts a rear side view of the frame assembly and a cross bar of the plurality of cross bars of the exemplary convertible chair bed device.

Referring now to FIGS. 1-3, there are depicted a front left perspective view (FIG. 1), a left side view (FIG. 2), and a right side view (FIG. 3) of a frame assembly of the exemplary convertible chair bed device. The padded base 9 is configured and sized to be inserted between the left bar support 3 and the right bar support 4, and the pluralities of notches (6, 7) removably accepts at least one cross bar of the plurality of cross bars 8, such that the angle between the first section 10 and the second section 11 is maintainable by placement of the second section 11 on the at least one cross bar of the plurality of cross bars 8. In addition, the padded base 9 is configured to be inserted between the left bar support 3 and the right bar support 4, such that the angle between the first section 10 and the second section 11 is maintainable by placement of the second section 11 on a floor of an environment containing the convertible chair bed device 1. In this manner, the individual can independently transition between a seated position and the supine position.

In the shown embodiment, each bar of the plurality of cross bars 8 includes a first ball attached to a first end of the bar and a second ball attached to a second end of the bar, such that a diameter of the first ball and a diameter of the second ball are each greater than a diameter of the bar. In this manner, the first ball and the second ball are configured to prevent lateral slippage of the bar if the bar is removably inserted into a pair of corresponding notches of the pluralities of notches (6, 7), thereby improving a safety of the convertible chair bed device 1.

In the shown embodiment, the cross member 5 is connected to the left bar support 3 at a position near a bottom and a middle of the left bar support 3, and the cross member 5 is connected to the right bar support 4 at a position near a bottom and a middle of the right bar support 4. The position near the bottom and the middle of the left bar support 3 is below the forward upper notch 7 of the plurality of notches (6, 7) of the left bar support 3, and the position near the bottom and the middle of the right bar support 4 is below the forward upper notch 7 of the plurality of notches (6, 7) of the right bar support 4. From a side perspective, as shown in FIG. 2, these positions align such that the cross member 5 is perpendicular to the left bar support 3 and the right bar support 4. Further, the cross member 5 is configured to be positioned underneath a hinge of the padded base 9 if the padded base 9 is inserted between the left bar support 3 and the right bar support 4, such that the hinge pivotally connects the first section 10 and the second section 11. In this manner, the cross member 5 does not interfere with a pivoting movement of the second section 11, relative to the first section 10, during use. In addition, the cross member 5 does not interfere with the individual using the convertible chair bed device 1. In this manner, a comfort of the individual using the convertible chair bed device 1 is maximized.

Figure 4:
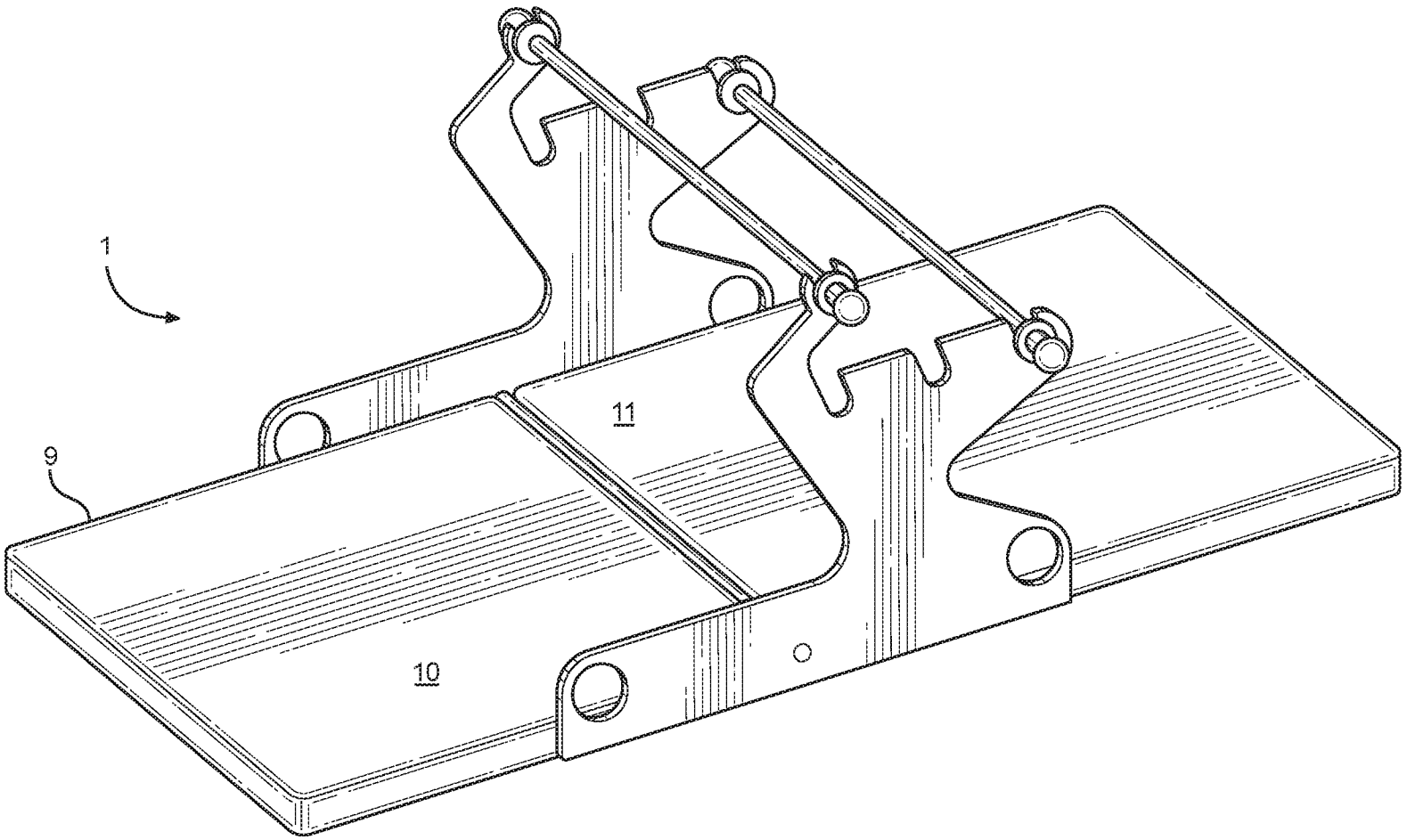
FIG. 4 depicts a front left perspective view of the exemplary convertible chair bed device, with a padded base member inserted therein and maintained in a supine position.

Referring now to FIG. 4, there is depicted a front left perspective view of the exemplary convertible chair bed device, with a padded base member inserted therein and maintained in a supine position. The convertible chair bed device 1 includes the padded base member 9, having the first section 10 pivotally connected to the second section 11. In the shown embodiment, the angle of the first section 10 relative to the second section 11 is about 180 degrees, and the convertible chair bed device 1 is configured to support the individual using the convertible chair bed device 1 in the supine position. In the shown embodiment, at least one cross bar of the plurality of cross bars is inserted into the plurality of notches, thereby making it easier for the individual to transition from the supine position to the seated position.

Figure 5:
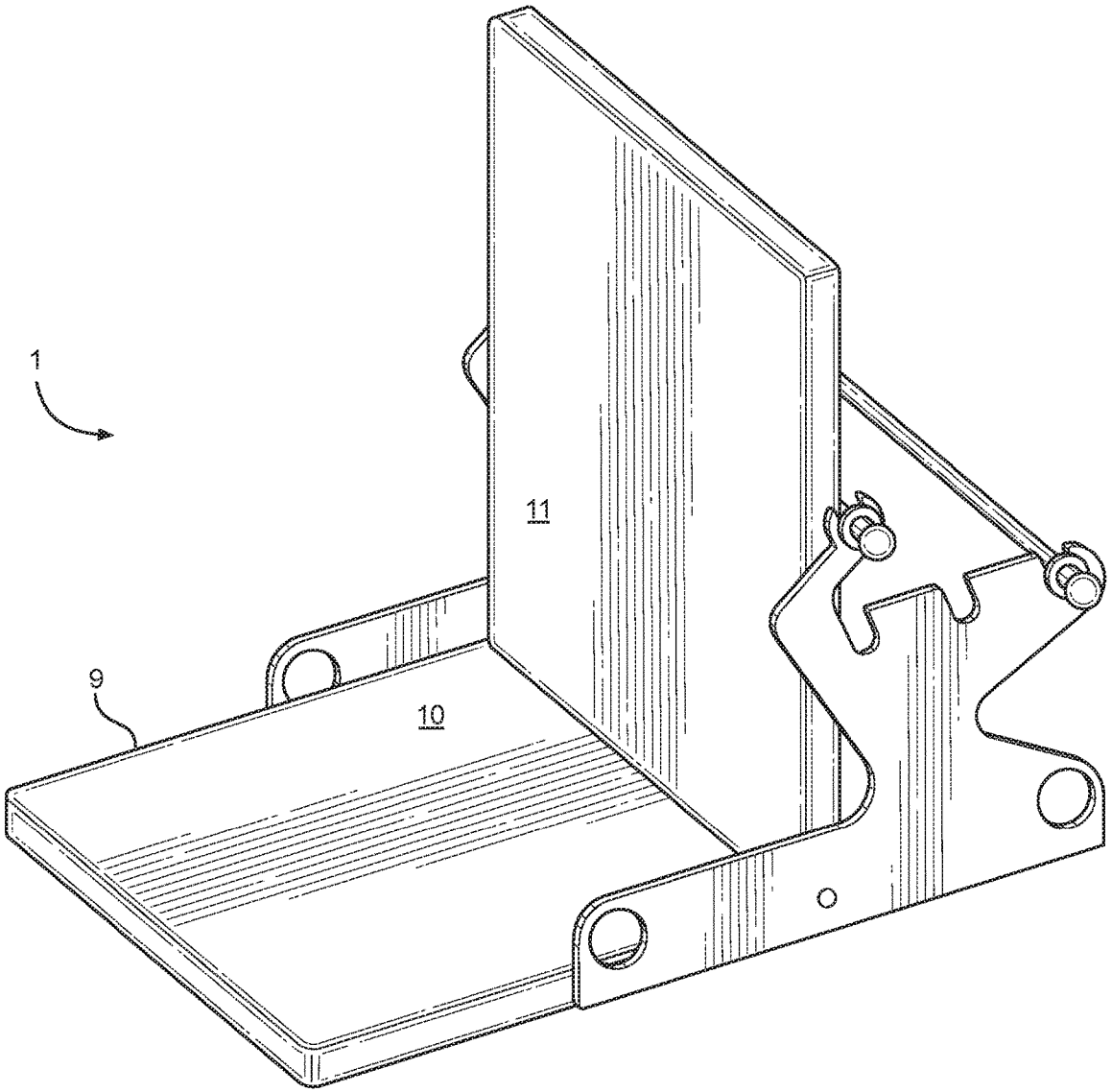
FIG. 5 depicts a front left perspective view of the exemplary convertible chair bed device, with the padded base member inserted therein and maintained in an upright seated position.

Referring now to FIG. 5, there is depicted a front left perspective view of the exemplary convertible chair bed device, with the padded base member inserted therein and maintained in an upright seated position. The convertible chair bed device 1 includes the padded base member 9, having the first section 10 pivotally connected to the second section 11. In the shown embodiment, the angle of the first section 10 relative to the second section 11 is about 90 degrees, and the convertible chair bed device 1 is configured to support the individual using the convertible chair bed device 1 in the upright seated position. In the shown embodiment, at least one cross bar of the plurality of cross bars 8 is inserted into the plurality of notches (6, 7), thereby making it easier for the individual to adjust a position of the at least one cross bar to transition to the reclined seated position.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A convertible chair bed device, comprising:

a frame assembly, having a left bar support connected to a right bar support by a cross member, wherein the left bar support and the right bar support each have a plurality of notches configured to removably accept a plurality of cross bars therethrough;

a padded base, having a first section pivotally connected to a second section, wherein the padded base is removably insertable between the left bar support and the right bar support.

2. The convertible chair bed device of claim 1, wherein the padded base is inserted between the left bar support and the right bar support, wherein the pluralities of notches removably accepts at least one cross bar of the plurality of cross bars, wherein an angle between the first section and the second section is maintainable by placement of the second section on the at least one cross bar of the plurality of cross bars.

3. The convertible chair bed device of claim 1, wherein the padded base is inserted between the left bar support and the right bar support, wherein an angle between the first section and the second section is maintainable by placement of the second section on a floor of an environment containing the convertible chair bed device.

4. The convertible chair bed device of claim 1, wherein each bar of the plurality of cross bars includes a first ball attached to a first end of the bar and a second ball attached to a second end of the bar, wherein a diameter of the first ball and a diameter of the second ball are each greater than a diameter of the bar.

5. The convertible chair bed device of claim 1, wherein the cross member is connected to the left bar support at a position near a bottom and a middle of the left bar support, wherein the cross member is connected to the right bar support at a position near a bottom and a middle of the right bar support.

6. The convertible chair bed device of claim 5, wherein the cross member is configured to be positioned underneath a hinge of the padded base if the padded base is inserted between the left bar support and the right bar support, wherein the hinge pivotally connects the first section to the second section.

7. The convertible chair bed device of claim 1, wherein the left bar support includes a forward upper notch within the plurality of notches thereof, wherein the right bar support includes a forward upper notch within the plurality of notches thereof, wherein the forward upper notches are configured to removably accept the at least one cross bar of the plurality of cross bars therethrough, wherein if the forward upper notches removably accept the at least one cross bar therethrough, the angle is maintainable to configure the padded base to support an individual in an upright seated position.

8. The convertible chair bed device of claim 7, wherein the forward upper notch of the left bar support is disposed on an upper end of a left forward upper arm of the left bar support, wherein the forward upper notch of the right bar support is disposed on an upper end of a right forward upper arm of the right bar support, wherein the forward upper arm of the left bar support is angled rearwardly to position the forward upper notch of the left bar support above a rearward notch of the plurality of notches of the left bar support, wherein the forward upper arm of the right bar support is angled rearwardly to position the forward upper notch of the right bar support above a rearward notch of the plurality of notches of the right bar support.

9. The convertible chair bed device of claim 7, wherein each of the forward upper notches have an upper portion that is angled toward a front of the convertible chair bed device relative to a lower portion of each of the forward upper notches, wherein the forward upper notches are configured to facilitate insertion and removal of the at least one cross bar from a forward direction.

10. The convertible chair bed device of claim 7, wherein the left bar support includes a plurality of rearward notches within the plurality of notches thereof, wherein the right bar support includes a plurality of rearward notches within the plurality of notches thereof, wherein the pluralities of rearward notches are configured to removably accept the at least one cross bar therethrough, wherein if the pluralities of rearward notches removably accept the at least one cross bar therethrough, the angle is maintainable to configure the padded base to support the individual in a reclined seated position.

11. The convertible chair bed device of claim 10, wherein each rearward notch of the pluralities of rearward notches have an upper portion that is angled toward a front of the convertible chair bed device relative to a lower portion of each rearward notch of the pluralities of rearward notches, wherein the pluralities of rearward notches are configured to facilitate insertion and removal of the at least one cross bar from a forward direction.

12. The convertible chair bed device of claim 10, wherein removal of the at least one cross bar from the pluralities of notches allows the second section to lower to a floor of an environment containing the convertible chair bed device, wherein the angle is maintainable to configure the padded base to support the individual in a supine position.

* * * * *